US006796267B2

(12) United States Patent
DuBarry

(10) Patent No.: US 6,796,267 B2
(45) Date of Patent: Sep. 28, 2004

(54) REMINDER FOR PERIODIC TASKS INCLUDING TAKING MEDICATION

(76) Inventor: Suzanne DuBarry, 4691 White Oak Pl., Encino, CA (US) 91316

( * ) Notice: Subject to any disclaimer, the term of this patent is extended or adjusted under 35 U.S.C. 154(b) by 0 days.

(21) Appl. No.: 10/319,274

(22) Filed: Dec. 14, 2002

(65) Prior Publication Data

US 2003/0111006 A1 Jun. 19, 2003

Related U.S. Application Data

(60) Provisional application No. 60/341,712, filed on Dec. 18, 2001.

(51) Int. Cl.[7] ..... G09F 9/00
(52) U.S. Cl. ..... 116/308; 116/313; 116/316
(58) Field of Search ..... 116/306, 307, 116/308, 321, 322, 323, 324, DIG. 3, 313, 315, 316, 319, 311, 312; 206/459.1

(56) References Cited

U.S. PATENT DOCUMENTS

| | | | | | |
|---|---|---|---|---|---|
| 163,302 | A | * | 5/1875 | Dike | 116/321 |
| 332,208 | A | | 12/1885 | Noel | |
| 630,822 | A | | 8/1899 | Bates | |
| 1,317,660 | A | * | 9/1919 | Carlson | 116/308 |
| 1,397,079 | A | | 11/1921 | Cohen | |
| 1,421,219 | A | | 6/1922 | Harmon | |
| 1,796,398 | A | | 3/1931 | Richardson | |
| 2,636,469 | A | | 4/1953 | McKay | 116/133 |
| 2,695,000 | A | * | 11/1954 | Farkas et al. | 116/324 |
| 3,996,879 | A | | 12/1976 | Walton | 116/121 |
| 4,625,675 | A | * | 12/1986 | Rosenberg | 116/324 |
| 4,666,051 | A | | 5/1987 | Trick | 215/230 |
| 4,825,803 | A | * | 5/1989 | Ammann et al. | 116/324 |
| 4,951,596 | A | | 8/1990 | Wallace, Jr. | 116/321 |
| 5,062,209 | A | * | 11/1991 | Rais | 30/41.7 |
| 5,216,975 | A | | 6/1993 | Bartholomew | 116/324 |
| 5,331,919 | A | | 7/1994 | Root et al. | 116/323 |
| 5,586,087 | A | | 12/1996 | Silverson | 368/10 |
| 5,660,138 | A | * | 8/1997 | Hirsch | 116/308 |
| 5,694,882 | A | | 12/1997 | Marshall | 116/311 |
| 5,899,335 | A | * | 5/1999 | Boyer et al. | 206/538 |
| 5,979,356 | A | * | 11/1999 | Emery | 116/324 |
| 5,979,698 | A | | 11/1999 | Deal | 221/2 |
| 6,032,609 | A | | 3/2000 | Luoma | 116/306 |
| 6,152,067 | A | | 11/2000 | Mathison | 116/308 |
| 6,335,907 | B1 | | 1/2002 | Momich et al. | 368/10 |
| 6,675,620 | B1 | | 1/2004 | Heyll et al. | 116/121 |
| 2003/0111005 | A1 | * | 6/2003 | Lord et al. | 116/307 |

* cited by examiner

*Primary Examiner*—Christopher W. Fulton
*Assistant Examiner*—Travis Reis

(57) ABSTRACT

Reminders of daily or other periodic tasks are most desirable when they are simple to operate and easily distinguishable. A reusable device that provides tracking of task performance by multiple independently movable arms that lock into position provides a clear visual cue as to use and eliminates potential unintentional movement of the arms. The arms can be pivotally or slidably mounted to a base. The pivotal mounting can include a mechanical hinge or a flexible material providing a living hinge. The lock releasably secures the arms independently in two or more positions indicating to the user the performance of a task such as taking a medication one or more times during a day or other period of time. At the end of the cycle of use, usually one week, the arms may be reset and the device used again. The device may be small enough and include a fastener to mount it to a pill bottle, specific to what is in need of reminding the user. Another version the device rests on a table, preferably in an area that is frequented by the user to visually remind the user to take the medication or performing another activity.

32 Claims, 5 Drawing Sheets

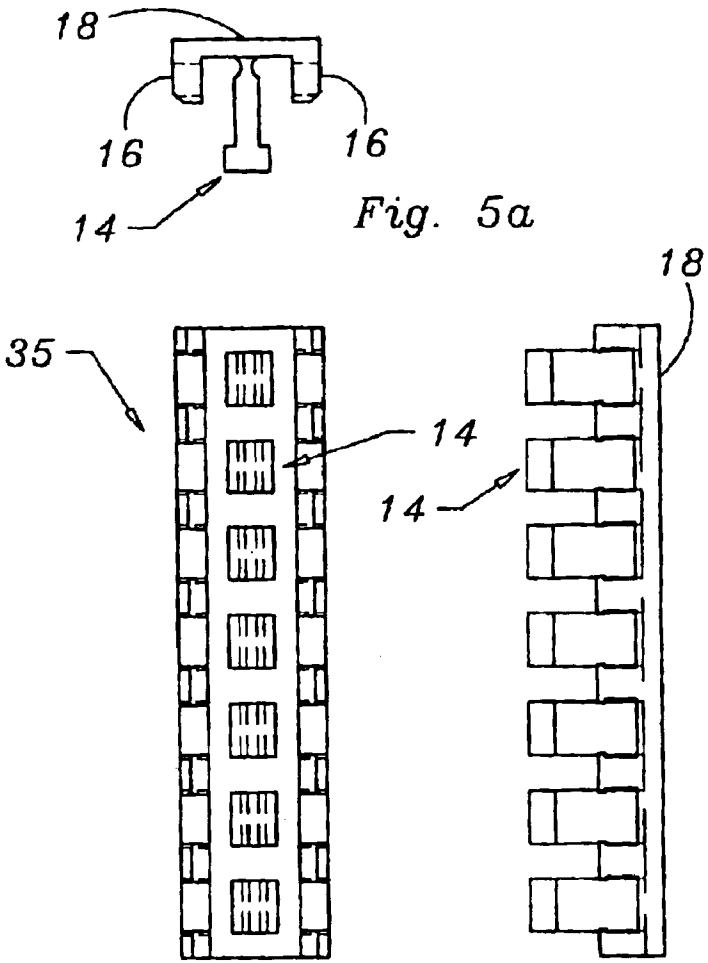
Fig. 5a
Fig. 5b
Fig. 5c
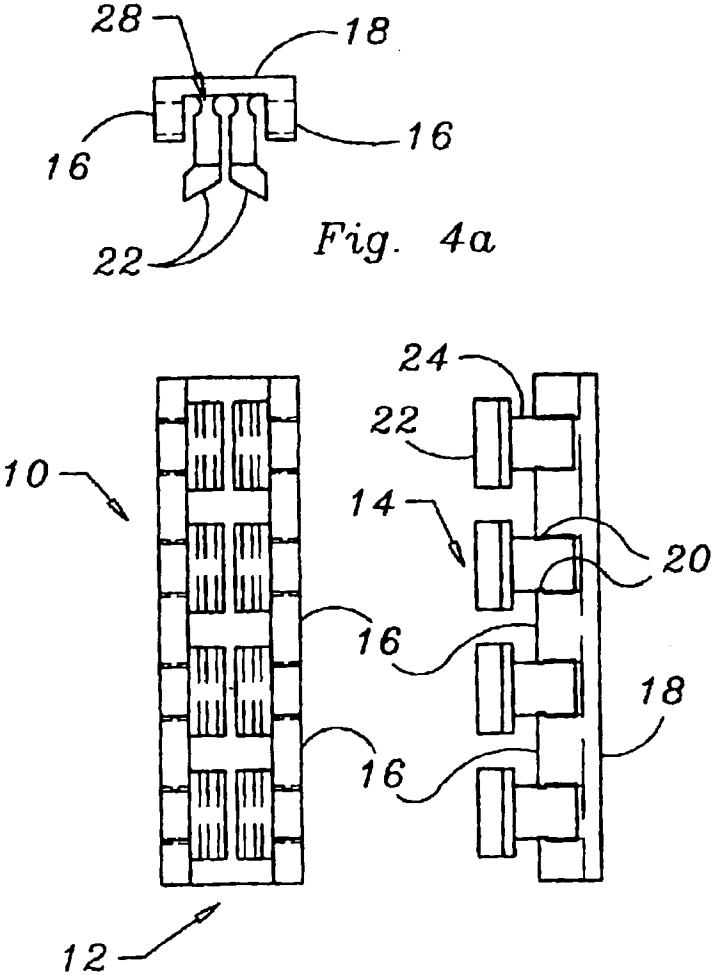
Fig. 4a
Fig. 4b
Fig. 4c

REMINDER FOR PERIODIC TASKS INCLUDING TAKING MEDICATION

This application claims the benefit of Provisional Application No. 60/341,712, filed Dec. 18, 2001.

FIELD OF THE INVENTION

The present invention generally relates to devices used to remind a user to perform a specific task. More specifically, the present invention relates to a reminder used and tracking in relation to taking medicine and other scheduled periodic tasks.

BACKGROUND OF THE INVENTION

Some individuals, especially the elderly, have difficulty remembering what and of which medications or other ingestible products they have taken that day. Some people take several items every day. Some items such as antibiotics are only taken for a period of time. Some items such as blood pressure medication or thyroid medications will likely be taken for the rest of their lives. In addition, some of these items are taken once a day and others multiple times every day. With this diversity and given that many elderly patients take several medications, keeping them all straight is a bit of a challenge. As the memory and eyesight also fade with age, remembering what was taken and reading each label to see if it should be taken, can present a problem. Even young, alert and healthy individuals who are sometimes overwhelmed by life, work, family and other responsibilities can forget if they have taken their medication or vitamins today. This is especially apparent with temporary treatment, such as antibiotics, where the medication is only taken for a short period of time. In this case the patient is not able to generate a routine based around taking the medication. Other periodic activities can also warrant a reminder, such as brushing their teeth. A physical reminder is desirable that can be positioned on or near the relevant object such as a pill bottle and that includes a lock to avoid inadvertent movement of the reminder arms.

SUMMARY OF THE INVENTION

In one aspect, the invention features a base frame supporting a plurality of independently movable arms. The base frame further includes an indicator to distinguish between the arms. A locking mechanism is also provided to enable the arms to be releasably secured in more than one position relative to the base frame.

The system may also include a base frame with a mount, thus enabling the frame to be mounted onto a pill bottle. This mount may include a mounting device including a mechanical fastener or an adhesive fastener, such as two-sided tape. The base may include a table support, thus enabling the frame to be supported on a flat surface such as a table, desk or counter.

The plurality of independently movable arms numbers at least seven arms, and are preferably mounted to the base frame by a pivotal mounting such as a living hinge connecting the arm to the frame. The arms may also be mounted to the frame by a slideable mounting.

The indicator is preferably comprised of a plurality of symbols, each associated with a specific arm. The symbols may be abbreviations designating the days of the week, or the time of the day. The locking mechanism may be comprised of a mechanical lock, which includes an interference lip, or a friction lock.

In another aspect, the invention includes a method of reminding an individual to medicate, including the steps of providing a device as previously disclosed, locating an arm associated with a specific term, assessing the need to medicate upon evaluating the position of the arm and moving the arm in relation to taking a specified medication. This term is preferably a specific day of the week.

BRIEF DESCRIPTION OF THE DRAWINGS

The foregoing and other objects of this invention, the various features thereof, as well as the invention itself, may be more fully understood from the following description, when read together with the accompanying drawings, described:

FIG. 4*a* is a top view of an eight arm paired reminder, the device produced in accordance with the present invention.

FIG. 4*b* is a front view of an eight arm paired reminder, the device produced in accordance with the present invention.

FIG. 4*c* is a side view of an eight arm paired reminder, the device produced in accordance with the present invention.

FIG. 5*a* is a top view of a seven arm unpaired reminder, the device produced in accordance with the present invention.

FIG. 5*b* is a front view of a seven arm unpaired reminder, the device produced in accordance with the present invention.

FIG. 5*c* is a side view of a seven arm unpaired reminder, the device produced in accordance with the present invention.

For the most part, and as will be apparent when referring to the figures, when an item is used unchanged in more than one figure, it is identified by the same alphanumeric reference indicator in all figures.

DETAILED DESCRIPTION OF THE PREFERRED EMBODIMENT

Figure 1:
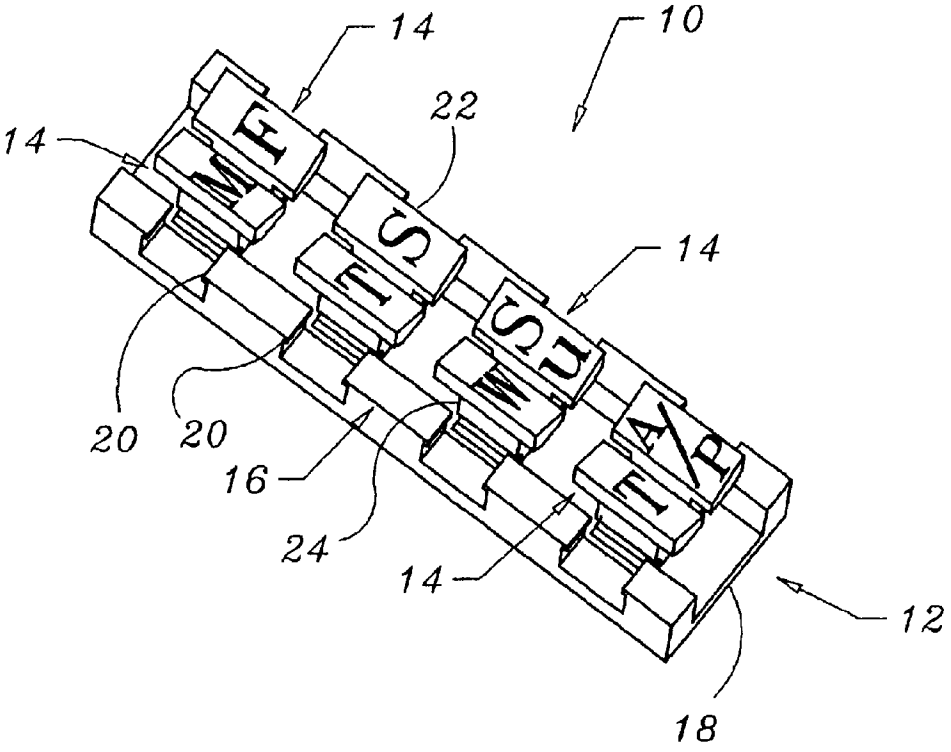
FIG. 1 is an isometric view of a reminder with all arms in the unlocked position, the device produced in accordance with the present invention.

The present invention is used as a reminder for taking medicine and other periodic use products. What is shown in FIG. 1 is an isometric view of a reminder 10 in the form of a preferred embodiment of the present invention. The reminder 10 includes a base frame 12, which supports a plurality of arms 14. These arms 14 are movably mounted to the base 12, in this case being pivotally mounted. The base includes risers 16, which extend up from the back 18 and are positioned on either side of each arm 14. The risers 16 act as a lock in that, in this embodiment, they include an interference lip 20, which extends slightly over the open area between each riser 16. In this embodiment, each arm 14 includes a tab 22 and a stem 24. The tab 22 enables articulation with a finger of the user or a blunt object, such as a pencil or an ink pin. The stem 24 may be reduced in size from the tab 22 and offers a means of positioning the tab 22 away from the base 12. When a tab 22 is displaced to the side between the risers 16, the interference lip 20 is flexed to allow passage of the stem 24. As the stem 24 clears the lips 20, the lips 20 regain their original shape and oppose the reverse movement of the stem 24 and associated tab 22, thus releasably locking the arm 14 in a down position. This position is shown in the following figure.

Figure 2:
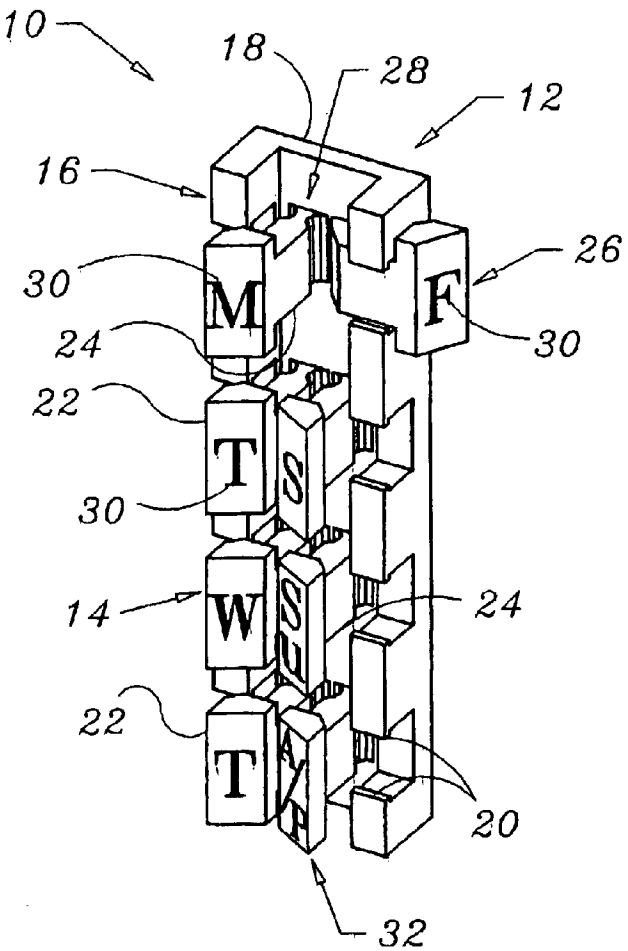
FIG. 2 is an isometric view of a reminder with one arm in the locked position, the device produced in accordance with the present invention.

The end of the stem 24 opposite to the tab 22 is mounted to the base 12 in such a manner that it allows movement of the tab 22 as previously disclosed. This can be done by providing a hinge to mount the substantially rigid structure to the base 18, or by manufacturing the stem 24 of a pliable material. The latter is considered optimal in view of manufacturability and cost. In FIG. 2 the "Friday" arm 26 is flexed to the side and locked in a down position. In this view the stem 24 is shown to include a reduced area 28. This reduced area 28 provides a lower section modulus and is therefore more flexible. By manufacturing the reminder 10 from a material that is pliable and resilient (such as polyolefins (e.g. polyethylene), polyurethanes and polystyrenes) the reduced area 28 becomes a "living hinge". This provides a multitude of deformations of the material without marked structural damage to the material. Another method would be by providing a mechanical hinge through a pivot pin (not shown), which would be received by the stem 24, thereby allowing it to pivot on the base 12. This pivot or any other form of making a pivotal attachment is inherently included in this disclosure as being known in the art.

A symbol 30 is preferably associated with each tab 22. This can be marked directly on the tab 22, as shown here, or on the base 12 near each tab 22. The symbols 30 can vary according to the intended use of the reminder 10. In most cases a day of the week in the form of an abbreviation is used. Here the days of the week (starting with Monday) is used and an "A" for a.m. and a "P" for p.m. When a pill or other medication is to be taken once a day, after taking the medication, the arm 14 associated with that day is displaced, down if it was in the up position, or up if it was in the down position. The A/P arm 32 is set down for p.m. and up or a.m. In this case if a medication is to be taken twice a day, morning and evening, this arm 32 will be used with the other arms 14 to remind the user if the medication has been taken that day and which time during the day. As an example being shown here, the medication for that week was started on Friday and was taken in the morning, but has not yet been taken in the evening in that the A/P arm 32 is still in the up position.

Figure 3:
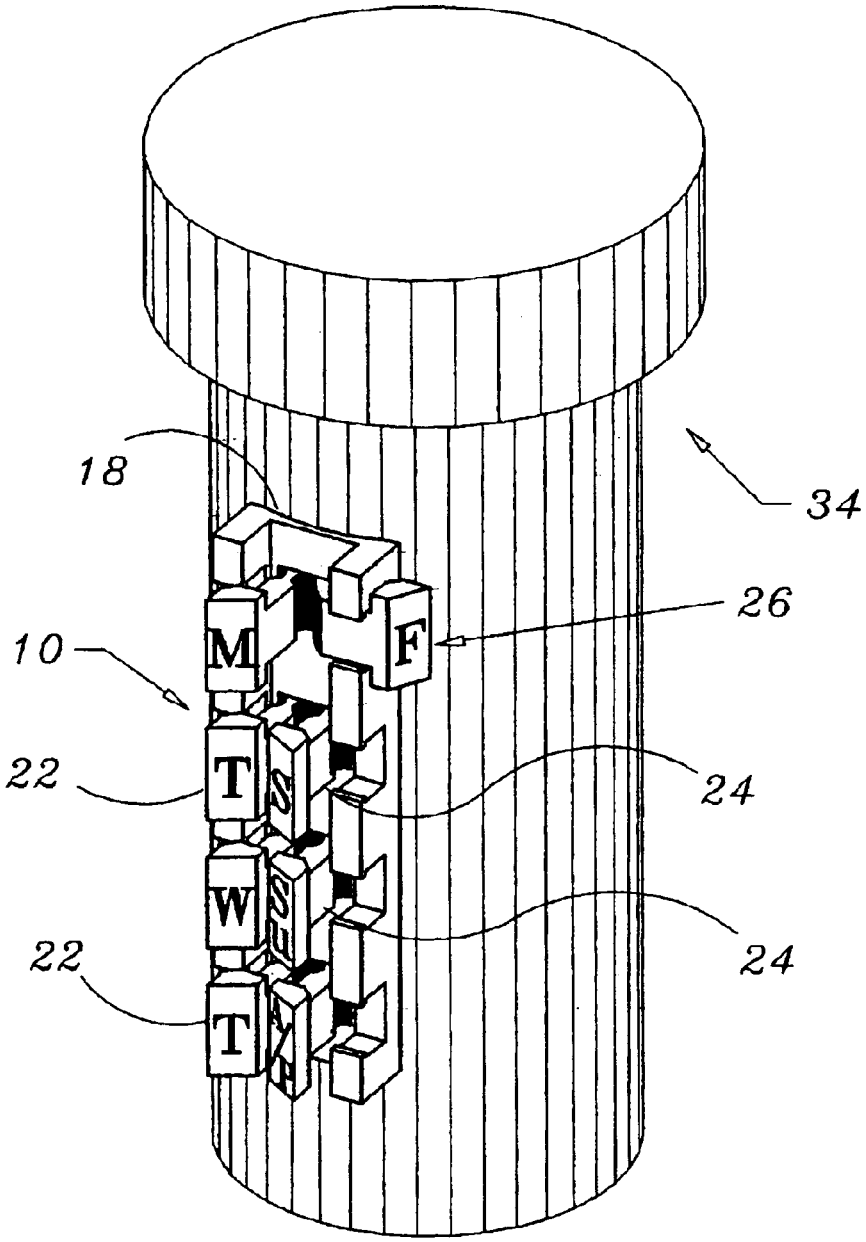
FIG. 3 is an isometric view of a reminder with one arm in a locked position and mounted to a pill bottle, the device produced in accordance with the present invention.

By setting the arms 14 in pairs, a two position (on and off or up and down) data can be determined from each arm 14 while being placed in a "side by side" arrangement. This is done to reduce the overall size of the reminder 10 while maintaining a tab 22 size that is functionally large enough to be articulated by the finger of a user. This is more clearly illustrated in FIG. 3 where the reminder 10 is attached to a traditional pill bottle 34 (not part of the invention). The orientation of the reminder 10 is not critical to the invention but it is preferable to position the reminder 10 vertically along a side of the bottle 34. In that there are labels on virtually every pill bottle, it is advantageous to minimize the surface area obstructed by the reminder 10. The reminder 10 can be attached to the pill bottle 34 in a number of methods. It can be permanently fixed to the bottle, as it would be attached by mechanical fasteners (screws or rivets) or adhesives. The user or pharmacist can also attach it at any time, such as just prior to purchase by the user. An adhesive or double sided tape can be placed on the back 18, which is then mounted to the side of the pill bottle 34. The product can be easily mounted to anything, as such, the user can mount one to a tube of toothpaste to remind them to brush their teeth or on the bathroom mirror as a reminder to take one or more medications, vitamins, or to perform any other periodic activity or task. In addition, the reminder 10 can be molded directly into a pill bottle or other container.

A top, front and side view of a paired eight-arm reminder 10 is shown in FIGS. 4*a*, 4*b* and 4*c* respectively. Here the tab 22 is clearly shown being supported by the stem 24, which is pivotally mounted to the base 12. The interference lips 20 offer a gap that is slightly less than the width of the stem 24. This provides the interference to lock the arm 14 in a down position and prevent it from falling down when in an up position. The elastic component of the material will tend to keep the arm 14 upright, but in the case of a pivotal mounting the interference lip 20 will aid in reducing the likelihood of inadvertent movement of the arms 14. In all of the forms of the invention provided in this disclosure, the locking device can also take a variety of forms. Where manufacturer's tolerances can be held relatively well, the inside of the risers 16 can contact the outside edges of the stem 24. The friction between these parts can be engineered to be sufficient to lock the arm 14 down when placed in that position, and to prevent it from accidentally "falling" from an up to a down position and yet maintaining the ability to actuate the arms 14 by the user.

An alternative form of the reminder is shown in top, front and side views in FIGS. 5*a*, 5*b* and 5*c*. Here a seven-arm single row reminder 35 allows for three positions of each arm 14. The risers 16 on each side of the arms 14 allow for each arm 14 to be locked into position on the right, the left or in the up or neutral position. The basic function of the reminder 35 is similar to that as previously disclosed, only the need for a morning and evening arm (A/P) is no longer needed. A left lock for any of the seven daily arms 14 is associated with the medication being taken that morning. Vertical, or neutral refers to the medication being untaken and to the right, depicting it was taken in the evening. At the end of every week the user moves all arms to the neutral position and starts over.

Figure 6:
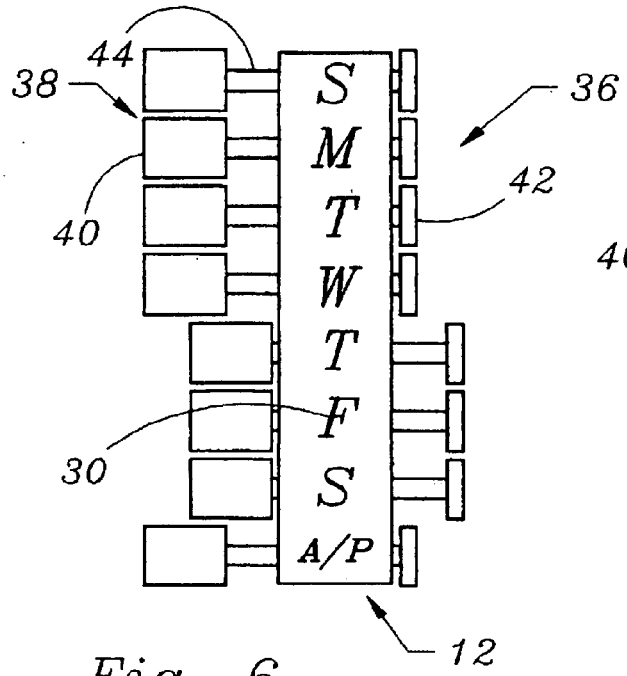
FIG. 6 is a front view of an assembled sliding reminder, the device produced in accordance with the present invention.

A sliding reminder 36 is shown in FIG. 6. The arms now take the form of slider arms 38. The base 12 enables receipt of these slider arms 38 allowing a restricted linear reciprocating motion for each arm 38. Each slider arm 38 includes a finger tab 40 and a stop 42. Each tab 40 and stop 42 are connected by a slider bar 44, which fits into and is guided by a track within the base 12. The stop 42 provides an end of movement for the arm 38 as it moves within the boundaries of the slider arm 44 as contained by the base 12.

The base 12 optimally includes the symbols 30 which identify the day of the week and/or time of the day. These can be included on the arms 38, and there would be room on the finger tabs 40 to place a symbol 30. Though it is understood this can be easily done, it is many times advantageous to have these symbols permanently fixed on the device 38. As such, molding these symbols into the structure is optimal. If the symbols 30 were molded into the arms 38, a variety of different arms, 38 would need to be manufactured, inventoried and properly assembled. With the symbols 30 on the base 12, the arms 38 are all the same part and the base 12 is still one part. The result is a lower manufacturing cost, though functionally the product would work equally well in either embodiment.

Figure 7:
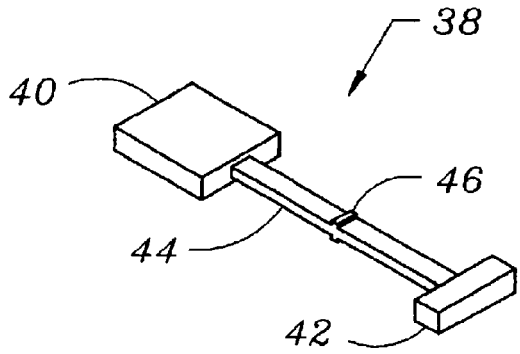
FIG. 7 is an isometric view of a sliding arm of a reminder, the device produced in accordance with the present invention.

A single slider arm 38 is shown in FIG. 7. The finger tab 40 and stop 42 connected by the slider bar 44 is more clearly shown. In this form, the lock is comprised of a dimple 46 on one or more surfaces of the slider arm 38, preferably as shown here on the slider bar 44. This dimple 46 offers an interference with a structure on the base 12. This is functionally equivalent to the interference lips or the friction lock as previously disclosed. The dimple 46 can provide high friction "drag" to oppose movement of the arm 38, or work with a ramp structure to "snap" over center making two or more distinct positions of the arm 38 relative to the base 12.

Figure 8:
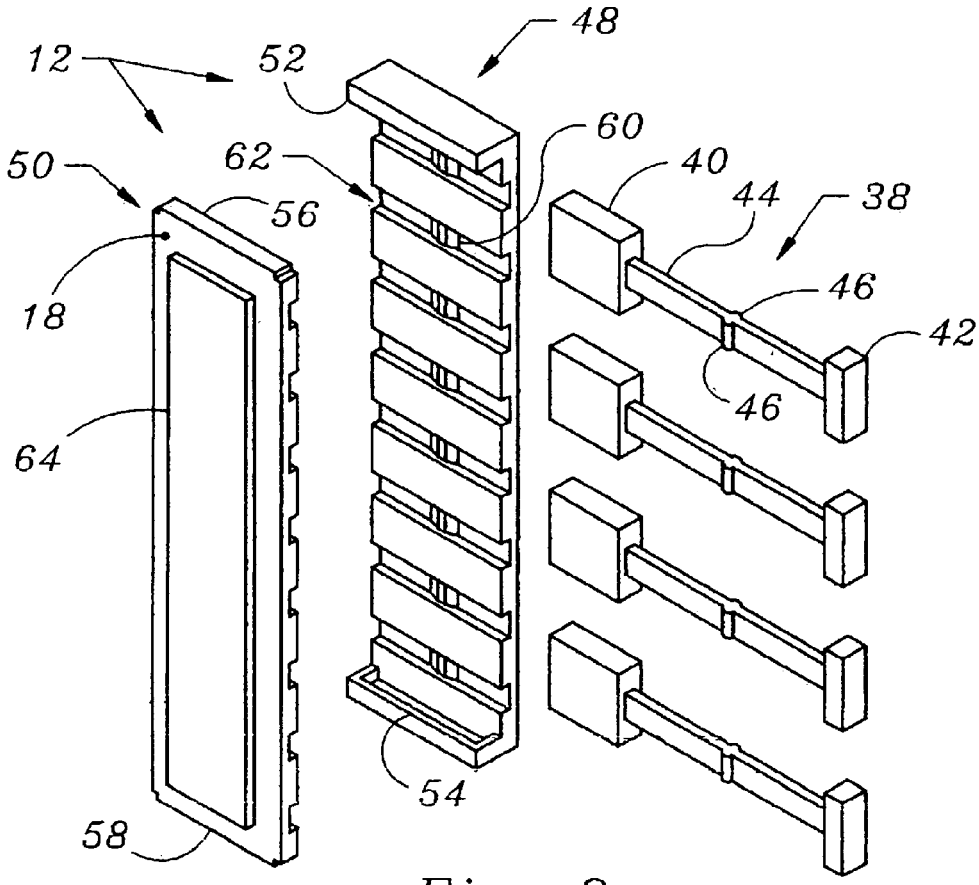
FIG. 8 is an exploded view of a sliding reminder, the device produced in accordance with the present invention.

The internal structure of the base 12 is more completely shown in FIG. 8. Here the base 12 is shown to be a two-part construction. This is desirable for the assembly of the arms 38 within the base 12. The base 12 is comprised of a front portion 48 and a back portion 50. These portions (48 & 50) can be secured together by any number of means after the assembly of the arms 38. An adhesive can be used to weld the front portion 48 and back portion 50 together, or as is shown here, any number of mechanical methods of fastening can be used. As an example, an upper back receiver 52 and a lower back receiver 54 are used to enable receiving the upper end 56 and lower end 58 of the back portion 50, respectively. A material can be used that is capable of flexing enough to receive and spring back to lock the back portion 50 into place. This design would require no further fasteners.

In the preferred embodiment of this version of the invention, a ramp 60 is positioned within the channel 62 that receives the slider rod 44. This ramp 60 provides a position specific interference to the movement of the arm 38 relative to the base 12 to snap or lock the arm into one of two positions, right or left. Though only one ramp 60 is shown here, each channel can include multiple ramps 60 to provide multiple distinct positions relative to the base 12. In addition, the ramps can be on one side (front 48 or back 50) or both. These are design decisions that are each functionally equivalent to the scope of the invention. On the back 18 of the back portion 50 of the base 12, an adhesive is shown in the form of a piece of double sided tape 64. As previously noted, this is one form of attachment that is considered preferable in providing a method of fastening the invention to a bottle or other surface. In this exploded view only four of the eight arms are shown. This is done for illustrative purposes and it is intended that all eight would normally be used.

Figure 9:
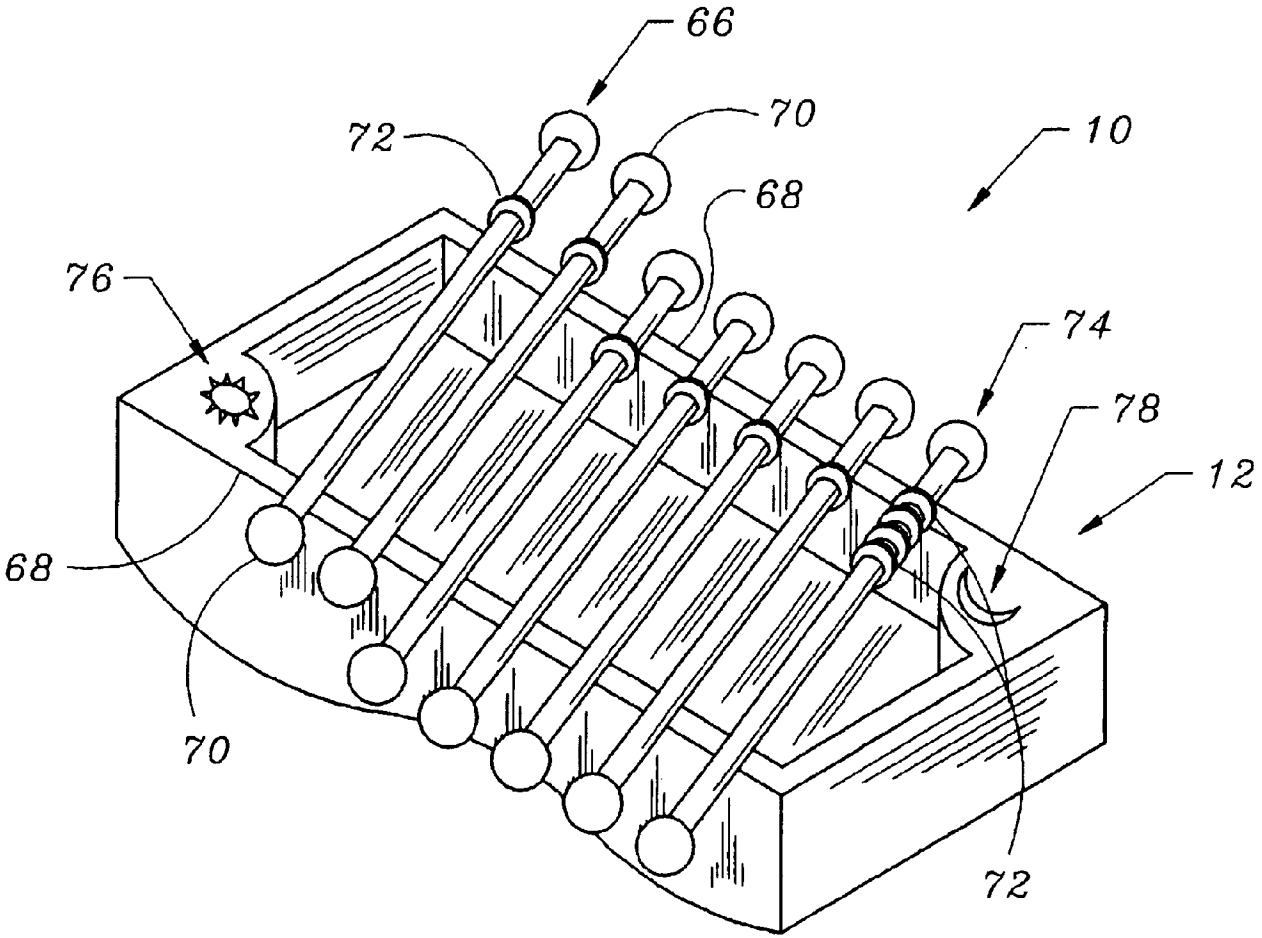
FIG. 9 is an isometric view of a table support version of a reminder, the device produced in accordance with the present invention.

A table-supported version of the reminder 10 is shown in FIG. 9. Instead of attaching to a bottle or mirror, this version of the invention is intended to be an attractive "sculpture" that rests on a bathroom counter or other location that is environmentally related to the task. This may be a bathroom counter if the purpose is to remind the user to take a medication that is stored in the medicine cabinet in the bathroom. The base 12 is preferably constructed of a substantially rigid material such as wood or metal. The arms 66 are supported in notches located in the rim 68 of the base 12. The end knobs 70 on each arm 66 are used to facilitate grasping the arm 66 as well as to act as a positioning guide and lock to keep the arms 66 in place relative to the base 12. A ring 72 is used to lock the arm 66 into position on one side or the other of at least one rim 68 of the base 12. This gives a clear visual cue as to the location of the arm 66 relative to the base 12, but locks the arm to prevent it from being accidentally moved. In all forms of the invention, rotating arms and sliding arms, but especially with sliding arms, multiple locks 72 can be used to provide multiple positioning of each arm to keep track of taking a medicine or other task that needs to be done several times per day. An example of such a multiple lock arm 74 is shown in one location of this embodiment.

The sun 76 and the moon 78 designs are used as examples of other symbols that can be used in addition to abbreviations of days and times in the form of alphanumeric symbols. As before, the day of the week, or any abbreviation deemed appropriate can be placed on the base 12 or any or all of the arms 66 & 74.

What is claimed is:

1. A product use reminder comprising:

a substantially longitudinal base frame supporting a plurality of independently movable arms, the arms including a tab with at least two faces and an indicator on at least one of said at least two faces; and a locking mechanism enabling releaseably secured positioning of each of said arms in a first position by pushing on one of said at least two faces and in a second position by pushing on a second of said at least two faces.

2. A reminder as in claim 1, wherein said base frame further includes a fastener, thus enabling said frame to be mounted onto a curved surface.

3. A reminder as in claim 2, wherein said fastener includes a device selected from the group consisting of a mechanical fastener and an adhesive fastener.

4. A reminder as in claim 3, wherein said adhesive fastener includes two-sided tape.

5. A reminder as in claim 1, wherein said base further includes a table support, thus enabling said frame to be supported on a flat surface.

6. A reminder as in claim 1, wherein said plurality of independently movable arms is at least seven arms.

7. A reminder as in claim 1, wherein said movable arms are movably mounted to said frame by a pivotal mounting.

8. A reminder as in claim 7, wherein said pivotal mounting includes a living hinge connecting said arm to said frame.

9. A reminder as in claim 1, wherein said movable arms are movably mounted to said frame by a slideable mounting.

10. A reminder as in claim 1, wherein said indicator is comprised of a plurality of symbols, each associated with a specific arm.

11. A reminder as in claim 10, wherein said symbols are abbreviations designating the days of the week.

12. A reminder as in claim 10, wherein said symbols are abbreviations designating the time of the day.

13. A reminder as in claim 1, wherein said locking mechanism is comprised of a mechanical lock.

14. A reminder as in claim 13, wherein said mechanical lock includes an interference lip.

15. A reminder as in claim 13, wherein said mechanical lock includes a friction lock.

16. A task reminder comprising:

a substantially longitudinal base absent of resealable cavities;

a plurality of arms moveably mounted to said base, the arms including a tab with at least two faces and an indicator on one of at least two faces; and a locking mechanism enabling said arms to be secured in at least two positions relative to said base, the arms moved by pushing on one of said at least two faces.

17. A reminder as in claim 16, wherein said base further includes a fastener, thus enabling said base to be mounted onto a curved surface.

18. A reminder as in claim 17, wherein said fastener includes a device selected from the group consisting of a mechanical fastener and an adhesive fastener.

19. A reminder as in claim 18, wherein said adhesive fastener includes two-sided tape.

20. A reminder as in claim 16, wherein said base further includes a table support, thus enabling said base to be supported on a flat surface.

21. A reminder as in claim 16, wherein said plurality of independently movable arms is at least seven arms.

22. A reminder as in claim 16, wherein said movable arms are movably mounted to said base by a pivotal mounting.

23. A reminder as in claim 22, wherein said pivotal mounting includes a living hinge connecting said arm to said base.

24. A reminder as in claim 16, wherein said movable arms are movably mounted to said base by a slideable mounting.

25. A reminder as in claim 16, wherein said indicator is comprised of a plurality of symbols, each associated with a specific arm.

26. A reminder as in claim 25, wherein said symbols are abbreviations designating the days of the week.

27. A reminder as in claim 25, wherein said symbols are abbreviations designating the time of the day.

28. A reminder as in claim 16, wherein said locking mechanism is comprised of a mechanical lock.

29. A reminder as in claim 28, wherein said mechanical lock includes an interference lip.

30. A reminder as in claim 28, wherein said mechanical lock includes a friction lock.

31. For use with a task reminder including a substantially longitudinal base, a plurality of arms including a tab with at least two faces and an indicator on one of at least two faces, and a locking mechanism enabling said arms to be secured in at least two positions relative to said base, the arms moved by pushing on one of said at least two faces, a method of reminding an individual to medicate including the steps of:

said individual locating one arm of said plurality of arms in accordance with said indicator;

contacting one face of said at least two faces and applying a force to said one face, thereby moving said one arm from a first position to a second position; and securing said one arm in a second position by said locking mechanism, whereby displacement of said one arm is associated with completion of a medication task.

32. A method as in claim 31, wherein said indicator relates to a specific day of the week.

* * * * *